US007780273B2

(12) United States Patent
Temple et al.

(10) Patent No.: US 7,780,273 B2
(45) Date of Patent: Aug. 24, 2010

(54) DROPLET DEPOSITION APPARATUS

(75) Inventors: Stephen Temple, Cambridge (GB); Paul Raymond Drury, Hertfordshire (GB)

(73) Assignee: XAAR Technology Limited, Cambridgeshire (GB)

( * ) Notice: Subject to any disclaimer, the term of this patent is extended or adjusted under 35 U.S.C. 154(b) by 341 days.

(21) Appl. No.: 11/631,909

(22) PCT Filed: Jul. 11, 2005

(86) PCT No.: PCT/GB2005/002746

§ 371 (c)(1),
(2), (4) Date: Nov. 29, 2007

(87) PCT Pub. No.: WO2006/005952

PCT Pub. Date: Jan. 19, 2006

(65) Prior Publication Data

US 2008/0117260 A1 May 22, 2008

(30) Foreign Application Priority Data

Jul. 10, 2004 (GB) ..... 0415529.7

(51) Int. Cl.
*B41J 2/045* (2006.01)

(52) U.S. Cl. ..... 347/69

(58) Field of Classification Search ..... 347/68–72
See application file for complete search history.

(56) References Cited

U.S. PATENT DOCUMENTS 4,842,493 A 6/1989 Nilsson
4,887,100 A 12/1989 Michaelis et al.
5,801,731 A * 9/1998 Takahashi ..... 347/69
5,844,587 A * 12/1998 Ando et al. ..... 347/69
5,901,425 A 5/1999 Bibl et al.
6,223,405 B1 5/2001 Oikawa et al.
2002/0135643 A1 9/2002 Sarojiniamma et al.

FOREIGN PATENT DOCUMENTS

CN 1074409 7/1993
EP 0 277 703 A1 8/1988
EP 0 427 186 A2 5/1991

(Continued)

OTHER PUBLICATIONS

International Preliminary Report on Patentability for International Application No. PCT/GB2005/002746, dated May 30, 2007.

(Continued)

*Primary Examiner*—An H Do
(74) *Attorney, Agent, or Firm*—Marshall, Gerstein & Borun LLP

(57) ABSTRACT

An actuator taking the form of a piezoelectric wall separating two chambers, which utilizes two actuation modes. Both actuation modes cause volume displacements in both chambers, but act to reinforce one another in one chamber and cancel one another in the other chamber. A fluid pump for droplet deposition having an array of channels separated by such actuators can be operated with each channel acting substantially independently of its neighbors.

16 Claims, 8 Drawing Sheets

FOREIGN PATENT DOCUMENTS

| | | | |
|---|---|---|---|
| EP | 0 528 648 | | 8/1992 |
| EP | 0 611 655 | A2 | 8/1994 |
| EP | 0 640 480 | A2 | 3/1995 |
| EP | 0 855 277 | A2 | 7/1998 |
| JP | 2004-142310 | | 5/2004 |
| WO | WO 95/07850 | | 3/1995 |

OTHER PUBLICATIONS

International Search Report for International Application No. PCT/GB2005/002746, dated May 16, 2007.

Annex to Form PCT/ISA/206—Search Results from PCT/GB2005/002746.

* cited by examiner

DROPLET DEPOSITION APPARATUS

BACKGROUND OF THE INVENTION

1.Field of the Invention

The invention relates to actuators and in particular to actuators for droplet deposition apparatus.

2.Related Technology

Droplet deposition apparatus or inkjet print heads are capable of placing small droplets of fluid onto a substrate. The apparatus, which will be called an inkjet print head even though fluids other than ink may be ejected—force the fluid from nozzles which communicate with an ejection chamber. Actuators corresponding with the ejection chamber apply the force that ejects the fluid. These actuators take a number of different forms but tend to fall within one of two categories. The first of which is mechanical, where an electrical pulse causes the actuator to deform, and includes such technology as electrostatic, thermal bend or piezoelectric for example. The second category is thermal or bubble actuators, where heat is applied to bring the fluid to its nucleation point. The resultant bubble pressurizes the ink in the chamber and forces some of it through the nozzle.

Piezoelectricity is a property of certain classes of crystalline materials including natural crystals of Quartz, Rochelle Salt and Tourmaline plus manufactured ceramics such as Barium Titanate and Lead Zirconate Titanates (PZT). Certain plastics such as PVDF can also express piezoelectric characteristics.

When mechanical pressure is applied to one of these materials, the crystalline structure produces a voltage proportional to the pressure. Conversely, when an electric field is applied, the structure changes shape producing dimensional changes in the material.

The piezoelectric effect for a given item depends on the type of piezoelectric material and the mechanical and electrical axes of operation. For certain types of piezoelectric material—notably PZT—these axes are set during "poling", the process that induces piezoelectric properties in the ceramic and the orientation of the poling field determines their orientation.

After the poling process is complete, a voltage lower than the poling voltage changes the dimensions of the ceramic for as long as the voltage is applied.

A voltage with the same polarity as the poling voltage causes additional expansion along the poling axis and contraction perpendicular to the poling axis. A voltage with the opposite polarity has the opposite effect: contraction along the poling axis, and expansion perpendicular to the poling axis. In both cases, the piezoelectric element returns to its poled dimensions when the voltage is removed from the electrodes. When a voltage is applied in a direction orthogonal to the poling direction the piezoelectric element moves in thickness shear or face shear.

Generally two or more of these actions are present at the same time. In some cases one type of expansion is accompanied by another type of contraction which compensate each other resulting in no change of volume. For example, the expansion of length of a plate may be compensated by an equal contraction of width or thickness. In some materials, however, the compensating effects are not of equal magnitude and net volume change does occur. In all cases, the deformations are very small when amplification by mechanical resonance is not involved.

FIG. 1 describes the standard directions of piezoelectric material. The three orthogonal axis are termed 1, 2 and 3. The polar, or 3 axis, is always taken parallel to the direction of polarization within the ceramic. The indexes 4, 5 and 6 represent a shear movement around the 1, 2 and 3 axis respectively. The direction of polarization is established during the poling process by a strong electrical field applied between two electrodes. To link electrical and mechanical quantities double subscripts (e.g. dij) are introduced. The first subscript gives the direction of the excitation, the second describes the direction of the system response. For example, d33 applies when the electric field is along the polarization axis (direction 3) and the strain (deflection) is along the same axis. d31 applies if the electric field is in the same direction as before, but the strain is in the 1 axis (orthogonal to the polarization axis)

It has been proposed in the prior art to manufacture droplet deposition apparatus, or fluid pumps from piezoelectric material. One structure, described for example in U.S. Pat. No. 4,842,493 provides a pump channel formed by first and second piezoelectric parts arranged parallel to one another. The parts are polarised such that the polarisation direction lies parallel to a field generated by the electrodes. Upon application of the field the piezoelectric parts expand both in $d_{31}$ and $d_{33}$ modes and thereby affect the pressure of the ejection chamber. For example, $d_{33}$ applies when the electric field is along the polarization axis (direction 3) and the strain (deflection) is along the same axis. $d_{31}$ applies if the electric field is in the same direction as before, but the strain is in the 1 axis (orthogonal to the polarization axis)

A shared wall device operating in shear or $d_{15}$ mode is described in U.S. Pat. No. 4,887,100. Two adjacent pressure chambers are separated by a single displaceable wall which can deflect towards or away from each of the chambers. When the wall deflects towards a first one of the adjacent chambers the pressure in this chamber is increased whilst the pressure in the other chamber is reduced. Similarly, when the wall deflects towards the second chamber the pressure in this chamber is increased with a corresponding reduction in the pressure in the first chamber. The pressure changes are primarily due to volume changes caused by the moving wall.

The provision of a shared wall allows for an increase in the chamber density and a reduction in the size of the print head for a given number of ejection chambers. However, as each wall acts on two chambers simultaneously it is not possible to fire droplets from each ejection chamber at the same time and hence this reduces the rate at which droplets can be ejected.

SUMMARY OF THE INVENTION

The invention provides improved apparatus and addresses these and other problems. According to one aspect the invention provides a fluid pump for droplet deposition comprising an array of pressure chambers arranged side by side in an array direction, a displaceable wall dividing adjacent pressure chambers and comprising piezoelectric material polarized in a direction parallel to said array direction and an electrode for applying an electric field thereto; and wherein the displaceable wall is disposed so as to be able under an electric field applied between said electrode to displace a volume in one of said adjacent chambers that is different to a volume displaced in the other adjacent chamber.

The volume displaced in the pressure chambers also displaces a corresponding volume of fluid. The fluid is preferably in liquid form but may also be a gas.

Preferably the volume displaced in the second adjacent chamber is substantially zero. that is to say that the displacement has no significant effect on the operation of the adjacent chamber.

The displaceable wall is preferably arranged to have a neutral axis offset from the geometric center of the displaceable wall. When such an arrangement undergoes a strain parallel to the (offset) neutral axis, a bending moment is induced resulting in a bending strain. The displaceable wall may have a stiffness which is greater on one side of the wall than on the opposite side of the wall. It is preferred that different faces of the wall have different stiffnesses effected by coatings applied to each side of the wall, however the structure of the wall could be adapted in alternative ways to offset the neutral axis, for example by providing weakening notches along one side. The coatings may have a functional feature other than simply stiffening portions of the wall such as, for example, a passivation function or an electrically conducting function. Two or more different coating materials may be provided on either or both sides of the wall in a layered arrangement. The same coating material, or materials may be provided on both sides of the wall in different thickness, the thickness on the or each side being selected to provide the relative difference in stiffness.

The electrode preferably comprises electrodes located on opposing faces of the wall such that a field generated between them lies parallel to the array direction. In a preferred embodiment the electrodes are of different thickness to provide the relative difference in stiffness.

The electrodes may be formed by electroless plating. A seed layer can be deposited on one side of each wall using a directional technique eg. vacuum plating. The seed layer is then plated up with a suitable electroless process, resulting on a plated layer on one side of the wall but not on the other. A seed layer is then deposited on the other side of each wall, and the electroless plating process continued. Although both sides of the wall will now be plated, the initial layer on one side only will result in differential thicknesses being maintained.

Alternatively, the electrodes could be formed by providing a seed layer to both sides of each wall, using a wet chemical process for example. Patterning is then performed to connect together the first sides of each wall in a first set, and separately to connect together the second sides of each wall in a second set. The walls are then differentially electroplated, the first set being plated for a longer period of time than the second set, or vice versa.

In a preferred embodiment the pressure chambers are substantially identical. For example, each pressure chamber may be of equal dimensions and comprise a nozzle through which fluid is ejected. In an alternative embodiment some of the pressure chambers may be designated ejection chambers from which droplets are ejected through a nozzle which the remaining chambers are designated dummy chambers from which no fluid is ejected. The dummy chambers may comprise liquid or air.

Both the dummy chambers and pressure chambers may be elongate channels with a direction of elongation being orthogonal to the array direction.

A cover may be provided which extends over the top of the channels thereby closing the top. In one embodiment the cover contains the nozzles through which droplets are ejected. In an alternative embodiment, the nozzles are formed in a nozzle plate which is attached to the front face of the pressure channels. The dummy channels may or may not have a cover closing their top surface.

The cover may be stiff or preferably have a degree of flexibility to allow flexure of the displaceable walls. a flexible hinge may be provided by, for example a flexible glue layer may adhesively join the tops of the displaceable walls with the cover.

Molding or sawing or a combination of the two may form the fluid pump.

BRIEF DESCRIPTION OF THE DRAWINGS

The invention is described below by way of example only with reference to FIGS. 1 to 12 in which.

DETAILED DESCRIPTION

Figure 2:
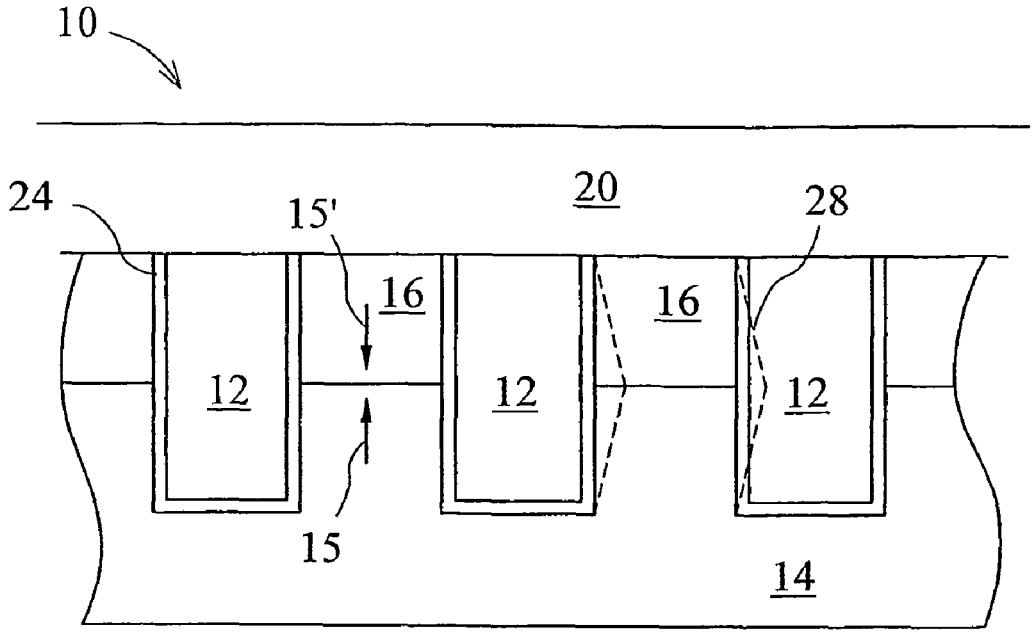
FIGS. 2 and 3 show an inkjet printhead arrangement using shear mode actuation

Referring to FIG. 2, an ink jet printhead 10 comprises a multiplicity of parallel ink channels 12 forming an array in which the channels are mutually spaced in an array direction perpendicular to the length of the channels. The channels are formed at a density of two or more channels per mm. in a laminated sheet 14 of piezo-electric material, suitably PZT, poled in the direction of arrows 15, 15' and are defined each by side walls 16 and a bottom surface, the thickness of the PZT being greater than the channel depth. The channels 12 are open topped and in the printhead are closed by a top sheet 20 of insulating material which is thermally matched to the sheet 14 and is disposed parallel to the bottom surfaces of the channels and bonded to the tops 22 of the walls 16. The channels 12 on their side wall and bottom surfaces are lined with a metallised electrode layer 24. It will be apparent therefore that when a potential difference of similar magnitude but opposite sign is applied to the electrodes on opposite faces of each of two adjacent walls 16, the walls will be subject to electric fields normal to the poling direction 15. The walls are in consequence deflected in shear mode, and are displaced to the positions indicated by the broken lines 28.

Figure 3:
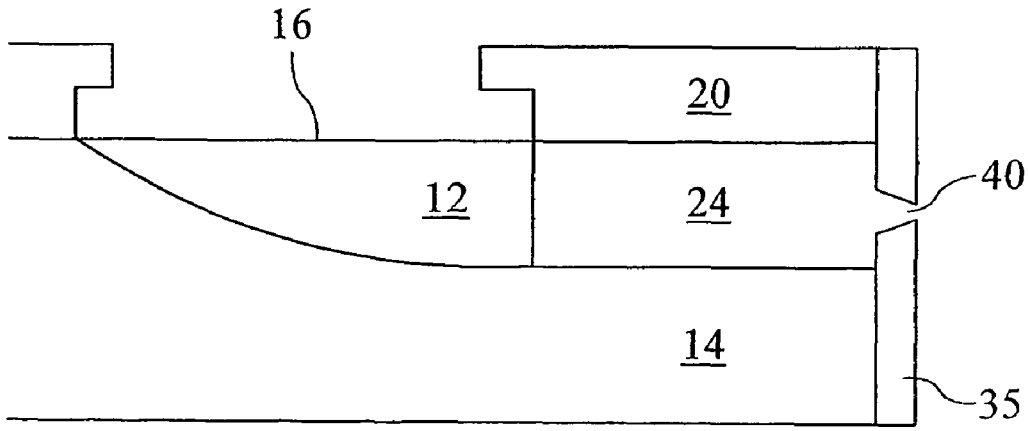

In FIG. 3, it will be seen that the channels 12 comprise a forward part of uniform depth which is closed at its forward end by a nozzle plate 38 having formed therein a nozzle 40 from which droplets of ink in the channel are expelled by activation of the facing actuator walls 16 of the channel. The channel 12 also has a part of lesser depth extending from the tops of the walls 16. The metallised plating 24 which is on opposed surfaces of the walls 16 occupies the depth of the channel side walls but does not extend the length of the channel to minimise the capacitive load of the print head. A suitable electrode metal used is an alloy of nickel and chromium, i.e. nichrome or electroplated or electroless plated nickel. The electrodes are deposited by first using a plating angle to allow electrode deposition on the full depth of the side walls. A mask is used to prevent deposition on the walls in the manifold region. The step is repeated to allow electrodes to be formed on both sides of each wall. A third step is carried out with deposition perpendicular to the to the base of the channels, such that deposition occurs on the bottom of each channel and the channel run out in the manifold region.

A droplet is ejected from each channel by applying a suitable waveform to the electrodes 24 on either side of the wall 16. A particularly preferred waveform is known as a draw-release-reinforce waveform. The volume of a selected channel is initially increased by drawing both walls bounding the chamber outwards and the walls are held in this position for a period of time. After the period of time has elapsed the walls are moved inwards to reduce the volume of the selected channel thereby ejecting a drop through the nozzle. Clearly as each wall acts on neighboring channels it is not possible to eject a droplet from both of the neighboring channels simultaneously. Care must also be taken that droplets are not ejected from unselected channels. These two features combine to reduce the maximum frequency at which droplets may be ejected from the channels.

Providing an "air gap" between each active channel can increase the frequency of operation of the print head of FIGS. 2 and 3. Air gaps may be narrower than ejection channels but it can be seen that this will reduce the channel density by up to 50%.

Another form of an actuator is described with reference to FIG. 4. Once again a multiplicity of parallel channels are formed which are separated from one another by parallel walls of a piezoelectric ceramic. The direction of polarization is, however, orthogonal to the direction of poling described with reference to FIG. 2. The walls are polarized in the array direction and electrodes provided on either side of the wall apply a field across the wall in a direction parallel to the polarization direction. Channels 12 are formed into one side of the PZT, and have nozzles 50 associated. Electrodes 24 are provided on the inside walls of the channels.

Figure 1:
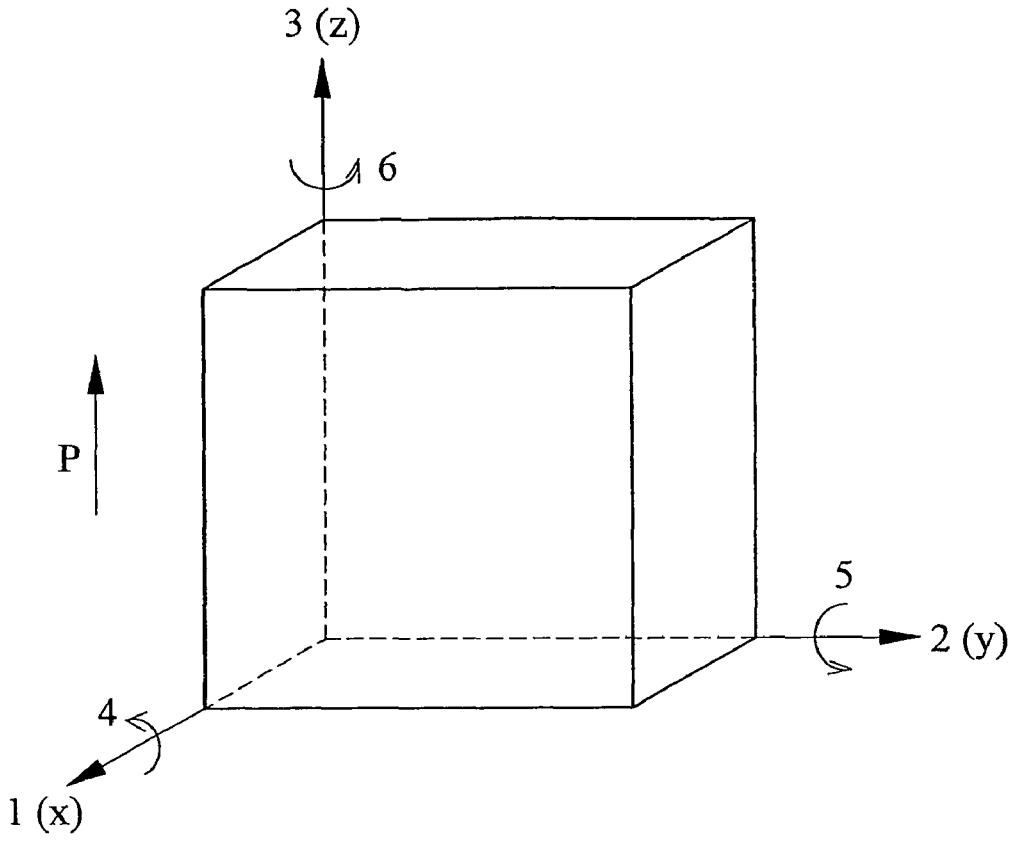
FIG. 1 illustrates standard directions for a block of piezoelectric material
Figure 4:
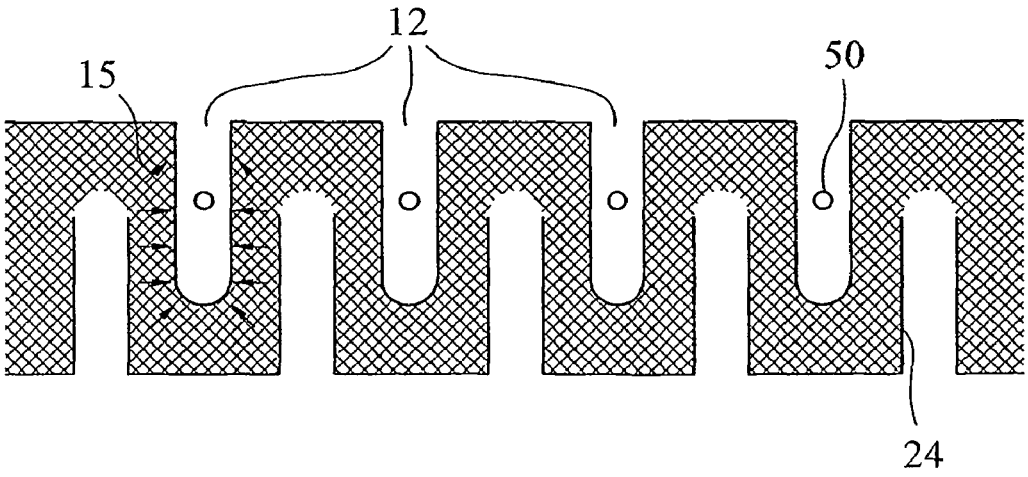
FIGS. 4 and 5 show an inkjet printhead using direct mode actuation
Figure 5:
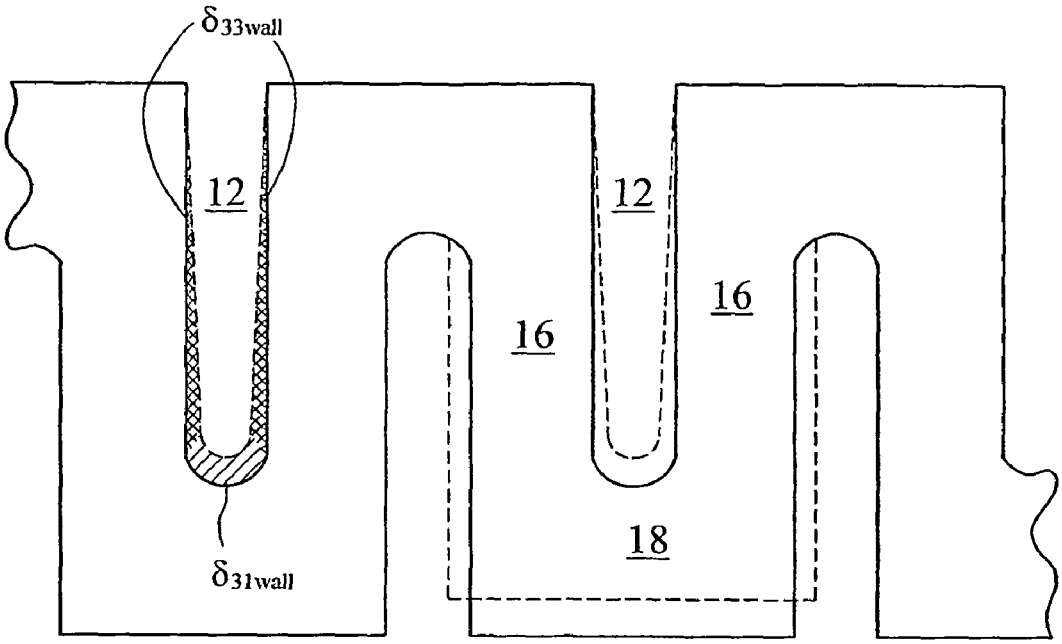

Looking in greater detail at FIG. 5, which is an enlarged view of the actuator of FIG. 4, the driving electrodes 24 are also used to apply the field which polarizes the PZT as shown by arrows 15 in FIG. 3. The electrodes on either side of the wall and base are of the same thickness. When a driving field is applied between the electrodes, the wall 16 will thicken in d33 and contract in height in d31 as depicted by the dotted lines. The net displacement for a given channel in these directions is given the nomenclature $\delta 33_{wall}$ and $\delta_{33wall}$. The total net displacement is therefore given by the equation:

$$\delta_{total}=\delta_{31wall}+\delta_{33wall}$$

Figure 6:
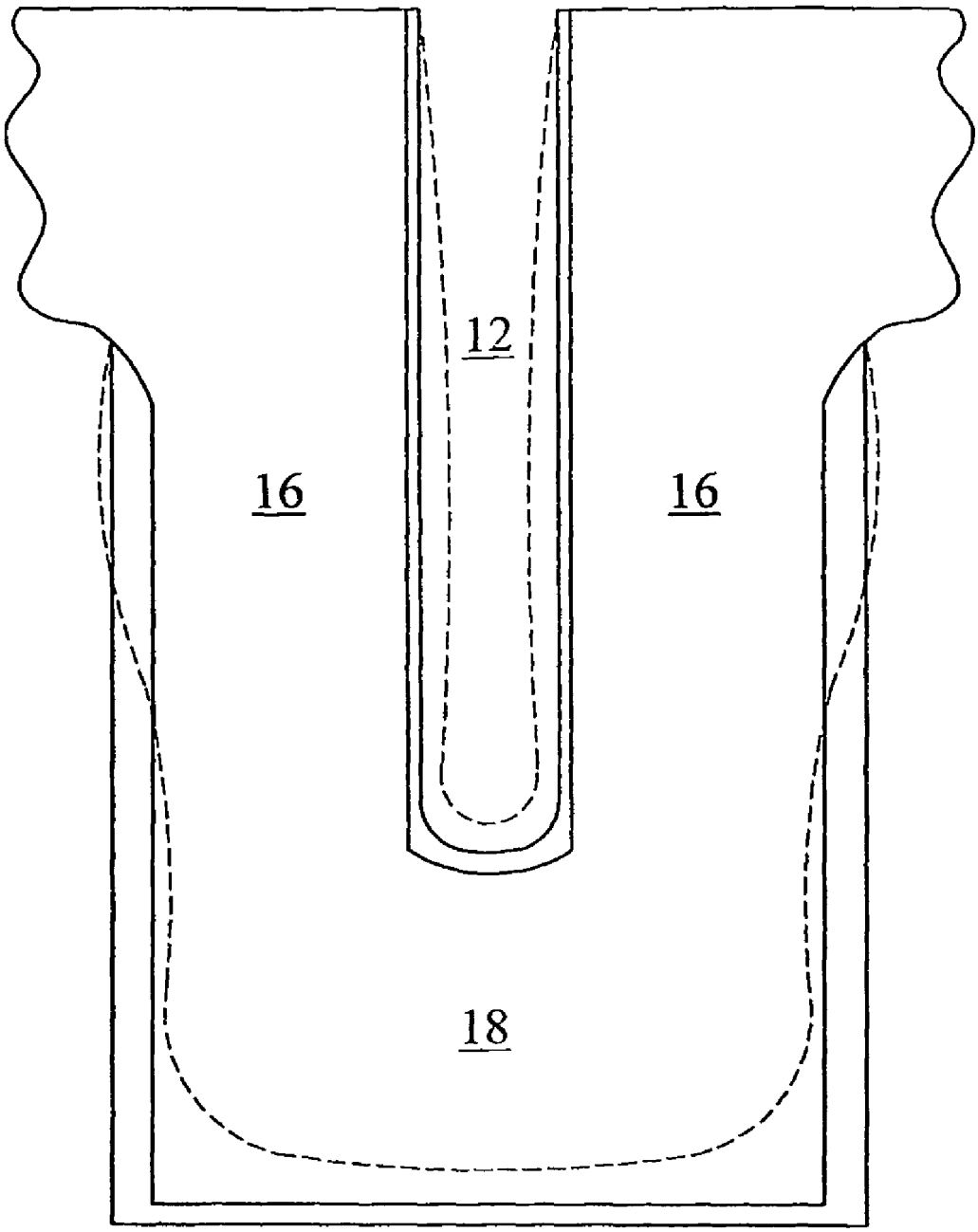
FIGS. 6 and 7 illustrate the use of bending in actuation.

An actuator in accordance with the invention is described with reference to FIG. 6. The piezoelectric material is polarized by applying a polarizing field between the driving electrodes. The electrodes, however, are of a different thickness depending on whether they are inside or outside the ejection chamber 12. This provides different stiffness to opposite sides of the wall that, it has been discovered by the applicant, improves ejection efficiency.

The ejection efficiency is improved as the different stiffness induces a bending moment to the actuator walls which increases the volume displaced by a value $\delta_{bending}$. The walls displace to a position as shown by the dotted lines. The total net displacement is therefore given by the equation:

$$\delta_{total}=\delta_{31wall}+\delta_{33wall+}\delta_{bending}$$

The stiffness of the base 18, however, can inhibit the bending movement of the wall and a design modification can be made to further improve the ejection efficiency. For example, the poling direction within the base may be reversed, or the thickness of the base may be reduced.

Figure 7:
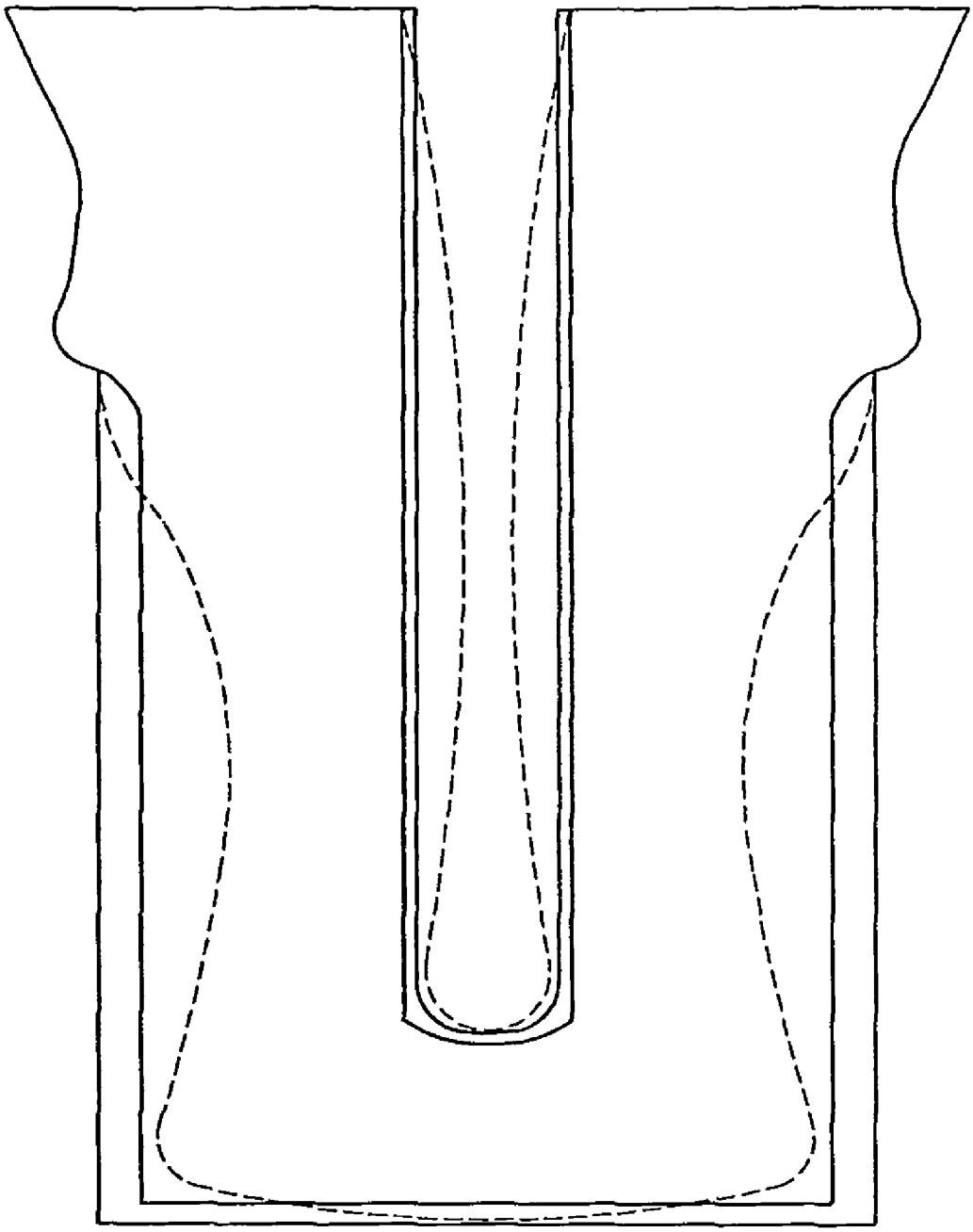

For example, the deflection in the case where a thinner base is provided is depicted in FIG. 7. $\delta_{bending}$ is increased and the overall volume displaced is improved.

The volumes displaced by the expansion or contraction of the piezoelectric material and the volumes displaced by the bending movement, especially where the bending is induced by a different stiffness provided on opposite faces of the piezoelectric material, can work together to either increase or decrease the total net volume displacement within a chamber.

If the differential plating is reversed, bending occurs in the opposite sense and opposes the displacements $\delta_{31wall}$ and $\delta_{33wall}$ to give the net volume displacement in a chamber as:

$$\delta_{total}=\delta_{33}+\delta_{31-}\delta_{Bending}$$

By selecting and operating at an appropriate value for $\delta_{Bending}$ it is possible, where $\delta_{Bending}=\delta_{33}+\delta_{31}$, to operate the actuator with substantially no net volume displacement in the channel.

Beneficially, by acting at or close to this situation it is possible to provide a shared wall droplet deposition apparatus where every channel may be actuated to eject a droplet simultaneously.

Figure 8:
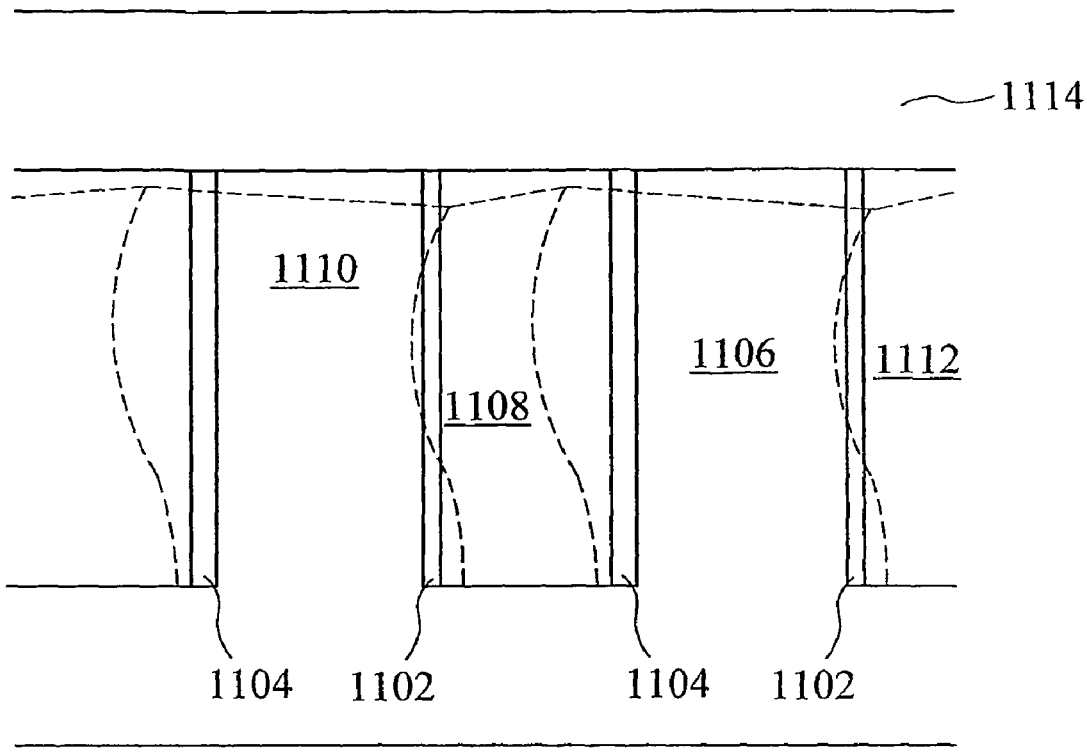
FIG. 8 shows an arrangement wherein channels can be actuate substantially independently.

This can be achieved by actuating only one wall for each channel, as shown in FIG. 8 in which displaced wall configurations are indicated by broken lines. In this arrangement differential plating of each wall is in the same 'sense', thinner plating 1102 on the right and thicker plating 1104 on the left as viewed. In this arrangement each channel is actuated by deflection of a single wall. Actuation of channel 1108 is achieved by deflection of wall 1106 alone. Although only one wall is being deflected, the net displacement in the channel is the sum of the piezoelectric expansion/contraction and bending effects. As explained above, actuation of wall 1106 does not substantially cause any net displacement in channel 1112. It will be appreciated that the neighboring channel 1112 can therefore be actuated substantially independently of channel 1108 (i.e., that these two neighboring channels can be actuated at the same time if desired).

In order for bending to occur as shown the structure should be sufficiently compliant at the top or the bottom (or both) of the wall to allow the necessary wall rotation there. For example the top plate 1114 may be made of a sufficiently compliant material. Alternatively a mechanical hinge could be employed where the wall meets the top or bottom plates.

Alternative wall structures which allow simultaneous actuation of neighboring channels are shown in FIGS. 9 to 12. Each of these figures depicts three walls defining two channels. The poling pattern for the walls is illustrated by arrows in the left hand wall, however different poling configurations may be possible to achieve the same actuated configuration, depending on the electrode placement and drive signal applied. Actuation in all cases is by the application of an electric field across the wall or wall portions (left to right or right to left as viewed). The central wall is shown in its actuated configuration, the wall deformation causing a net displacement in the left hand channel and substantially no net displacement in the right hand channel. Nozzles are not shown in these figures, but could be located in the roofs of the channels or at the ends of the channels.

Figure 9:
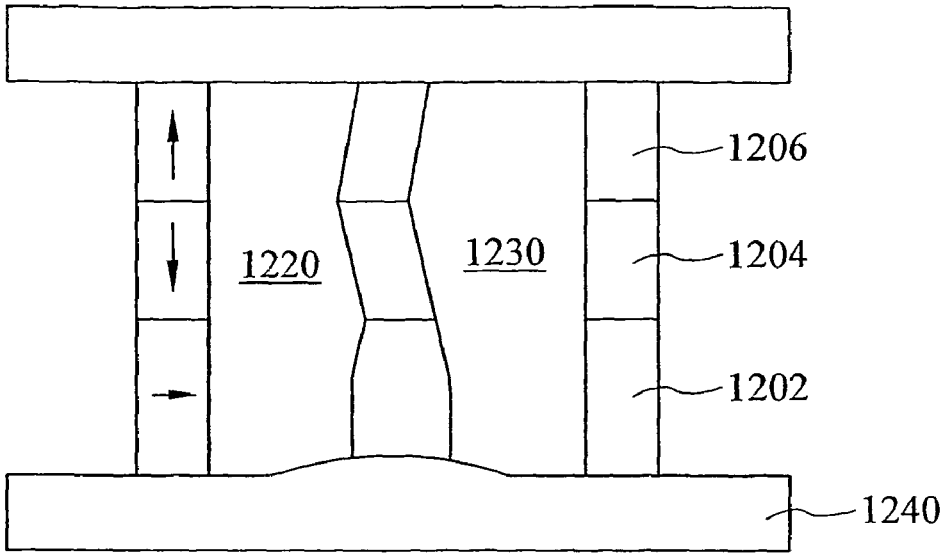
FIGS. 9 to 12 show alternative structures which allow simultaneous actuation of adjacent channels.

In FIG. 9, the lower portion of the channel wall 1202 acts in the so called direct mode, the applied electric field and poling being in the same direction causing expansion of that portion of the wall. The two upper portions of the wall 1204 and 1206, are poled in opposite direction perpendicular to the applied field, and act in shear producing a chevron like shape when actuated. It can be seen that when actuated, portion 1202 expands causing a reduction in volume of both channels 1220 and 1230. The chevron configuration of upper portions 1204 and 1206 however cause a reduction in volume of channel 1220, and in increase in volume of channel 1230. The displacements in channel 1230 can be made to cancel each other, thereby causing substantially no net change in volume in channel 1230, while the displacements in channel 1220 reinforce to cause droplet ejection from that channel. In this embodiment, actuation is effected by the application of a single field across the whole height of the wall.

Figure 10:
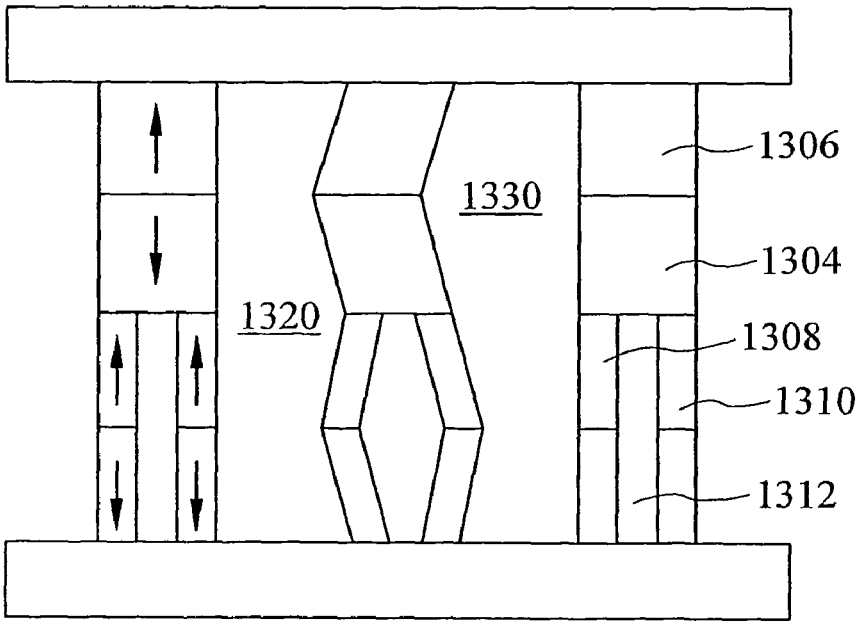

In preferred embodiments it will be necessary for the direct mode wall portion 1202 to have increased activity, to balance the activity of portions 1204 and 1206. This can be achieved by using a greater electric field across this portion, higher activity piezoelectric material, a greater wall height for this portion, or any combination of these. Alternatively or additionally, direct mode operation could be applied to the base or roof of the channels. It can be seen though that the contraction in height of the wall portion acting in direct mode will tend to cause deflection of the base portion 1240 causing some displacement in both neighboring channels. Referring to FIG. 10, upper wall portions 1304 and 1306 act in the same way as described above in relation to FIG. 9. The lower portion of the wall is formed of two pairs of chevron-like actuating portions 1308 and 1310, separated by a gap 1312. The gap may be filled with ink or air. When actuated lower portions 1308 and 1310 deflect in opposite senses, causing a volume reduction in both neighboring channels 1320 and 1330. As with FIG. 9, this structure can be arranged such that actuation of channel 1320 causes substantially no net volume change in channel 1330. This structure is more complex than that of FIG. 9, and this may result in an increased nozzle pitch resulting in lower resolution. Shear mode actuation typically has a longer life cycle than direct mode actuation however, and there is therefore advantage in an embodiment which uses only shear mode actuation.

In such 'double wall' structures, electrodes are typically formed on both the inside and outside faces of each wall, and the direction of polling in the walls will depend on how the electrodes are connected and the drive signals applied. Such arrangements may include an electrode layer having a break at a point part way up the height of the wall.

Figure 11:
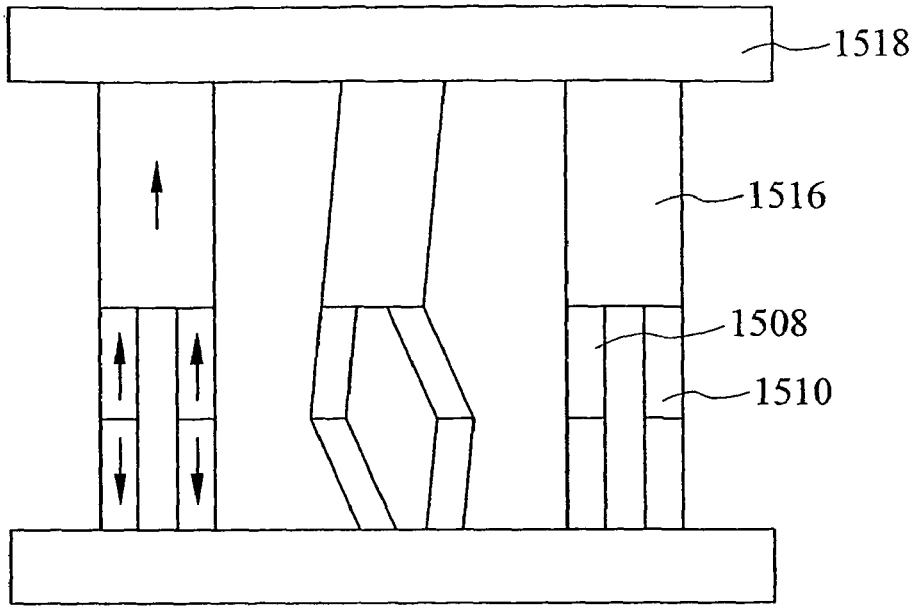

Two pairs of chevron-like actuating portions 1508 and 1510, separated by a gap 1512 are again used for the lower portion of the wall structure of FIG. 11. The upper portion 1516 is formed of a single portion of PZT poled in the same direction. On application of an electric field across the upper portion, it deforms in shear mode, as if like one half of a chevron arrangement. This acts as a cantilever, laterally displacing the centre of the wall, and causing a similar lateral displacement of the lower portion of the wall. Lower portions 1508 and 1510 displace in outwardly expanding chevrons as described previously, but additionally have a shear or skew superposed on them.

It should be noted that in the embodiment of FIG. 11, the member at the top of the channels 1518 should be relatively stiff and offer resistance to the bending moment induced by portion 1516 acting as a cantilever.

Figure 12:
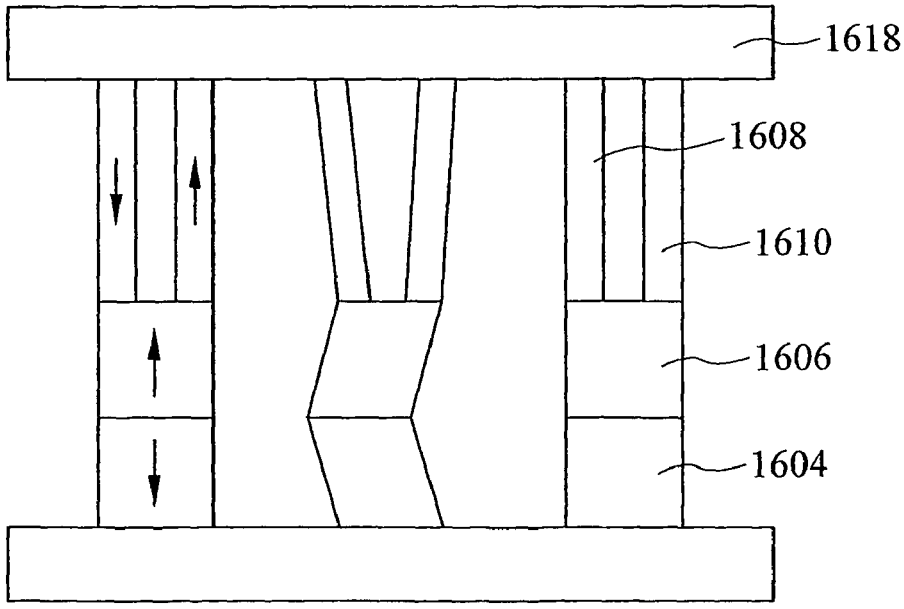

The embodiment of FIG. 12 employs wall portions 1604 and 1606, poled in opposite direction perpendicular to the applied field, deforming into a chevron on actuation. These portions are substantially the same as those described in FIGS. 12 and 13, but here they are use for the bottom, rather than the top portion of the wall. The top of the wall takes a double wall form, having two wall portions 1608 and 1610 separated by a cavity. Portions 1608 and 1610 each have a single direction of poling perpendicular to the applied field, but poled in opposite senses (achievable by poling using the electrodes for example). When activated, these portions each act as cantilevers, skewing outwards in opposite directions. It will be understood that in order to allow this deformation, member 1618 which may be a cover or nozzle plate in certain embodiments is required to exhibit a degree of compliance.

The embodiments of FIGS. 8 to 12 all employ two different modes of actuation, one causing displacements of the same sign in the two neighboring channels (i.e., reducing the volume in both channels or increasing the volume in both channels) and one causing displacement of opposite sign in the two neighboring channels (i.e., reducing the volume of one and increasing the volume of the other). In FIG. 8, the two different modes of actuation are superposed on the same wall portion, i.e., a single actuation surface undergoing two different modes of deflection. In FIGS. 9 to 12, the two modes of actuation can be considered to derive from different wall portions having different actuation modes. In FIG. 11 , upper and lower portions of the wall have different structures associated with different actuation modes, however there is some superposition of actuation modes in the lower portion as described above.

Although a number of combinations of different actuation modes have been described, still further combinations are possible.

The method of manufacturing a component will now be described with reference to FIG. 8. Initially PZT tiles and a substrate support are laminated together. Channels 1108, 1112 etc are sawn and a seed plating applied. The plating is patterned and the electrodes formed by electroplating. A passivation coating is applied over the electrodes and then the piezoelectric material is poled. Each wall may be polarized to a different level which allows for uniformity variations in the activity of the actuators to be evened out as higher activity walls may be polarized to a lesser extent. The benefit of poling late in the process is that high temperature processes may be used.

A particularly preferred form of passivation is a Faraday Cage. A faraday cage is produced, for example, when an electrically conducting layer is deposited over a non conducting layer when the non-conducting layer is deposited over electrodes.

Preferably each layer is conformal and cover the entire actuator. A nozzle is attached to the outer electrically conducting layer using an appropriate attach mechanism e.g. epoxy, thermocompressive, eutectic, anodic etc.

The nozzle plate attach may be reworked by a process where the outer electrically conducting layer is etched whilst the inner insulating layer is left. For example, the insulating layer may be parylene and the outer conducting layer copper. An etchant of either ferric chloride or Ammonium sulphate may be used to etch copper rapidly without effect on the parylene.

Upon completion of the etch the nozzle plate is released and free to be reworked or replaced. A new outer electrically conducting layer is then deposited onto the insulating layer and subsequently a replacement nozzle plate is then attached.

It is also possible to use the invention to provide other actuators e.g. for loudspeakers or the like. One particular benefit of using an actuator of the invention for a loudspeaker is that as there is no significant net displacement of the actuator on the opposite side substantially no sound will be reflected in reverse.

The invention claimed is:

1. A fluid pump for droplet deposition comprising:

an array of pressure chambers arranged side by side in an array direction, a displaceable wall dividing adjacent pressure chambers and comprising piezoelectric material polarized in a direction parallel to said array direction and an electrode for applying an electric field thereto; and wherein the displaceable wall is disposed so as to be able under an electric field applied between said electrode to displace a volume in a first one of said adjacent chambers that is different to a volume displaced in the other, second, adjacent chamber, and wherein the displaceable wall has a stiffness of one side of the wall which is greater than the stiffness of the opposite side of the wall.

2. A fluid pump according to claim 1, wherein the pressure chambers contain a liquid.

3. A fluid pump according to claim 1, wherein the volume displaced in the second chamber is substantially zero.

4. A fluid pump according to claim 1, wherein the displaceable wall has its neutral axis offset from its geometric center.

5. A fluid pump according to claim 1, wherein the side of the wall of greater stiffness is adjacent the pressure chamber exhibiting the greater volume displacement.

6. A fluid pump according to claim 1, wherein the stiffness of a side of the wall is effected by a coating formed on that side.

7. A fluid pump according to claim 6, wherein said coaling is electrically conductive.

8. A fluid pump according to claim 7, wherein said coating is formed by electroless plating.

9. A fluid pump according to claim 7, wherein said coating forms said electrode.

10. A fluid pump according to claim 7, wherein said coating further comprises a non conductive coating.

11. A fluid pump according to claim 10, wherein said non conductive coating is inorganic.

12. A fluid pump according to claim 6, wherein a coating is formed on both sides of said displaceable wall, the stiffness of each side being determined by the thickness of each coating.

13. A fluid pump according to claim 1, wherein said first adjacent chamber comprises a nozzle.

14. A fluid pump according to claim 13, wherein said second adjacent chamber comprises a nozzle.

15. A high density multi-channel array, electrically pulsed droplet deposition apparatus, comprising a multiplicity of parallel channels, mutually spaced in an array direction normal to the length of the channels, said channels having respective side walls which divide adjacent channels and extend in the lengthwise direction of the channels, and in a direction which is both normal to said lengthwise direction and normal to the array direction, respective nozzles communicating with said channels for ejection of droplets of liquid, connection means for connecting said channels to a source of droplet deposition liquid and electrically actuable means located in relation to said channels to effect, upon selected actuation of any channel, transverse displacement generally parallel to said array direction of at least part of a side wall of the selected channel said part extending at least a substantial part of the length of the channel, to cause change of pressure therein to effect droplet ejection from the nozzle communicating therewith, wherein the displacement of the side wall displaces a volume in said selected channel that is different to a volume displaced in the other channel adjacent to the side wall and wherein coatings are applied to opposing faces of said electrically actuable means, said coatings providing a different net stiffness for each face.

16. A method of forming an actuator for a fluid pump apparatus comprising the steps: providing a piezoelectric material comprising a first face and a second face, forming a conductive coating on said first and second faces, the conductive coating on said first face being stiffer than the coating on said second face and forming two pressure chambers such that said piezoelectric material divides said two pressure chambers and provides one wall thereof, wherein said piezoelectric material is actuable to displace a volume in a first one of said pressure chambers that is different to a volume displaced in the other, second, pressure chamber.

* * * * *